US007031434B1

(12) United States Patent
Saunders et al.

(10) Patent No.: US 7,031,434 B1
(45) Date of Patent: Apr. 18, 2006

(54) METHOD OF MANUFACTURING, AND A COLLIMATOR MANDREL HAVING VARIABLE ATTENUATION CHARACTERISTICS FOR A CT SYSTEM

(75) Inventors: Rowland Saunders, Hartland, WI (US); Steven Ross, Waukesha, WI (US); Thomas Toth, Brookfield, WI (US)

(73) Assignee: General Electric Company, Schenectady, NY (US)

( * ) Notice: Subject to any disclaimer, the term of this patent is extended or adjusted under 35 U.S.C. 154(b) by 307 days.

(21) Appl. No.: 10/604,634

(22) Filed: Aug. 6, 2003

(51) Int. Cl.
*G21K 5/04* (2006.01)

(52) U.S. Cl. ..... 378/150; 378/147

(58) Field of Classification Search ..... 378/145, 378/147, 148, 150, 151; 250/505.1
See application file for complete search history.

(56) References Cited

U.S. PATENT DOCUMENTS 3,407,300 A * 10/1968 Hansen ..... 378/149
3,997,794 A * 12/1976 York et al. ..... 378/149
4,991,189 A 2/1991 Boomgaarden et al.
5,054,041 A 10/1991 Hampel
5,644,614 A * 7/1997 Toth et al. ..... 378/147
5,692,088 A * 11/1997 Ishiharada et al. ..... 385/123
5,953,478 A * 9/1999 Sanghera et al. ..... 385/123
6,556,657 B1 * 4/2003 Tybinkowski et al. ..... 378/147
6,620,300 B1 * 9/2003 Singh et al. ..... 204/192.12
6,672,773 B1 * 1/2004 Glenn et al. ..... 385/70
2002/0144613 A1 * 10/2002 Gates et al. ..... 101/327

FOREIGN PATENT DOCUMENTS

JP 61037367 A * 2/1986

* cited by examiner

*Primary Examiner*—Edward J. Glick
*Assistant Examiner*—Chin-Cheng Glen Kao
(74) *Attorney, Agent, or Firm*—Ziolkowski Patent Solutions Group, SC; Michael A. Della Penna; Carl B. Horton

(57) ABSTRACT

A method of manufacturing a collimator mandrel having variable attenuation characteristics is presented. The manufacturing process includes the placement of a layer of attenuating material on a core of base material. The layer of attenuating material is relatively thin and varies in thickness circumferentially around the core. The collimator mandrel may be manufactured by placing a cast about a core of non-attenuating material, filling a void between the cast and the core with an attenuating material, allowing the material to cure, and removing the cast from the assembly.

18 Claims, 4 Drawing Sheets

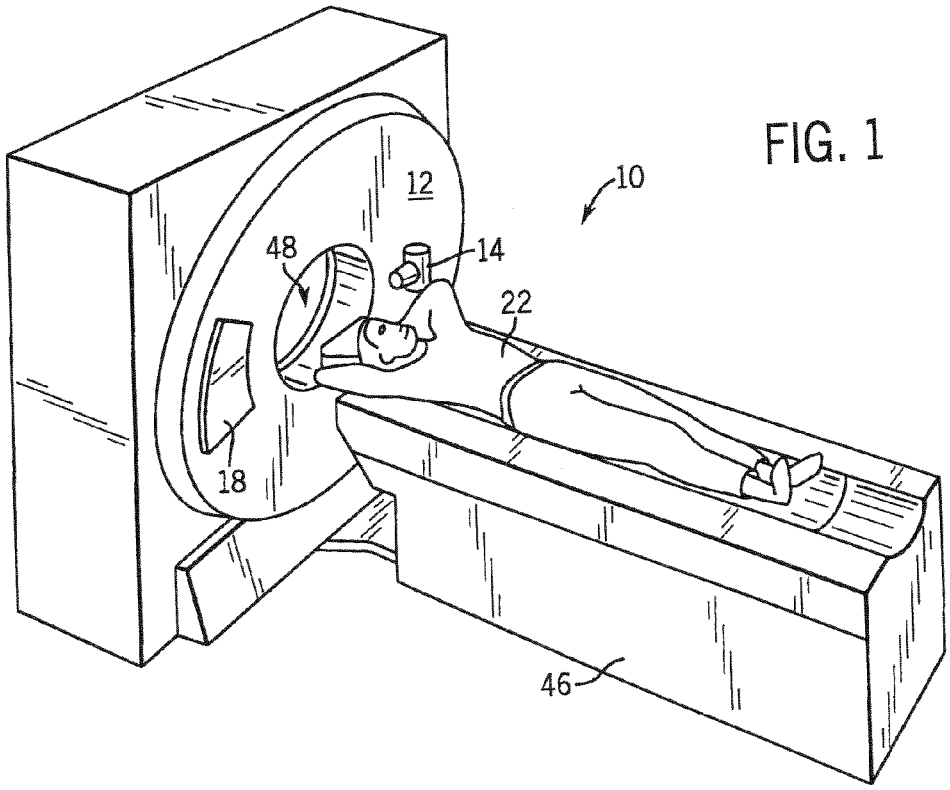
FIG. 1
FIG. 2
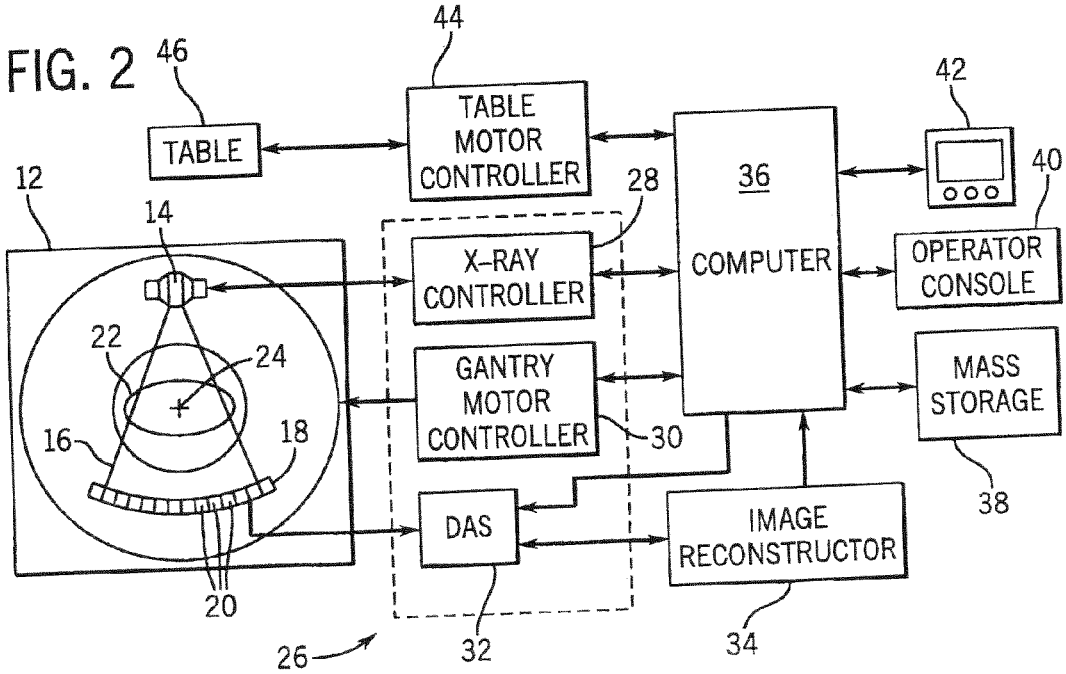

METHOD OF MANUFACTURING, AND A COLLIMATOR MANDREL HAVING VARIABLE ATTENUATION CHARACTERISTICS FOR A CT SYSTEM

BACKGROUND OF INVENTION

The present invention relates generally to computed tomography (CT) diagnostic imaging systems and, more particularly, to a method of manufacturing a collimator mandrel having variable attenuation characteristics.

Typically, in CT imaging systems, an x-ray source emits a fan-shaped beam toward a subject or object, such as a patient or a piece of luggage. Hereinafter, the terms "subject" and "object" shall include anything capable of being imaged. The beam, after being attenuated by the subject, impinges upon an array of radiation detectors. The intensity of the attenuated beam radiation received at the detector array is typically dependent upon the attenuation of the x-ray beam by the subject. Each detector element of the detector array produces a separate electrical signal indicative of the attenuated beam received by each detector element. The electrical signals are transmitted to a data processing system for analysis which ultimately produces an image.

Generally, the x-ray source and the detector array are rotated about the gantry within an imaging plane and around the subject. X-ray sources typically include x-ray tubes, which emit the x-ray beam at a focal point. X-ray detectors typically include a collimator for collimating x-ray beams received at the detector, a scintillator for converting x-rays to light energy adjacent the collimator, and photodiodes for receiving the light energy from the adjacent scintillator and producing electrical signals therefrom.

Typically, each scintillator of a scintillator array converts x-rays to light energy. Each scintillator discharges light energy to a photodiode adjacent thereto. Each photodiode detects the light energy and generates a corresponding electrical signal. The outputs of the photodiodes are then transmitted to the data processing system for image reconstruction.

Pre-patient collimators are commonly used to shape, or otherwise limit the coverage, of an x-ray or radiation beam projected from an x-ray source toward a subject to be scanned. Typically, the CT system will include a pair of collimator mandrels, each of which is mounted on an eccentric drive, such that the collimators may be positioned relative to one another to define a non-attenuated x-ray or radiation path. For example, by increasing the relative distance between the collimators, the width of the x-ray or radiation beam that impinges on the subject increases. In contrast, by moving the collimators closer to one another, the x-ray or radiation beam narrows. The eccentrics are designed to position the collimator mandrels with respect to one another and relative to an x-ray focal point to modulate the width of an x-ray or radiation path that bisects the collimators.

Collimators are frequently implemented to provide variable patient long axis (z-axis) coverage when a curvilinear detector assembly is used to detect radiation passing from the x-ray source through and around the subject during data acquisition. Conventional collimator mandrel configurations utilize a solid rod of attenuating material such as tungsten that is machined with a slight increase in diameter in the center of the mandrel relative to its ends. However, as the detector size increases in the z-axis, the constraints on the collimator tighten. Moreover, the collimator must be constructed to accommodate the increase in detector size while limiting x-ray coverage. Increased x-ray coverage increases patient radiation dose and degrades image quality due to the increased scatter in the reconstructed image. Accordingly, the collimator mandrel must be constructed to have a complex shape to accommodate the increase in detector size.

One known manufacturing process requires that the solid tungsten rod be machined to provide the complex shape necessary to achieve the desired beam shaping. Tungsten is a rigid material that is highly absorptive of x-rays. As such, tungsten is considered well-suited for collimator assemblies in CT systems. The rigidity of the tungsten, however, makes machining of a solid tungsten rod to have a complex shape difficult and time consuming. Moreover, machining with a precision required for a CT collimator can be difficult thereby compromising system performance.

Therefore, it would be desirable to have an accurate and repeatable manufacturing process capable of providing a precise and complex-shaped collimator mandrel for a CT system.

BRIEF DESCRIPTION OF INVENTION

The present invention is a directed to a manufacturing process overcoming the aforementioned drawbacks. The present invention provides a repeatable and precise process of constructing a collimator mandrel for a CT system. A rod of rigid material is positioned within a cast. The cast defines a void circumferentially around the rod which serves as a layout or pattern for an attenuating layer of epoxy, resin, or other material. Epoxy or other material is then deposited within the void and is allowed to cure. After curing, the cast is removed, and a complexly shaped collimator mandrel results. Alternatively, a thin layer of variable thickness may be deposited or sputtered directly on the outer surface of the rod to provide the complex shape desired.

Therefore, in accordance with one aspect of the present invention, a method of manufacturing a collimator mandrel for a CT imaging system includes the steps of forming a core of base material and applying a tapered layer of attenuating material to the core.

In accordance with another aspect of the invention, a CT collimator mandrel comprises a solid cylindrical rod positioned within a layer of attenuating material. The mandrel is formed by shaping a bulk of supporting material into a core and positioning the core in a cast such that a non-uniform void is created between an outer surface of the core and an inner surface of the cast. The mandrel is further formed by injecting attenuating material into the void and removing the cast upon curing of the attenuating material.

According to yet another aspect, a process of constructing a mandrel for a CT imaging system is provided and includes the steps of forming a solid cylindrical rod of first material and depositing a layer of second material designed to substantially block x-rays on the cylindrical rod.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings:

FIG. 1 is a pictorial view of a CT imaging system.

FIG. 2 is a block schematic diagram of the system illustrated in FIG. 1.

DETAILED DESCRIPTION

Figure 3:
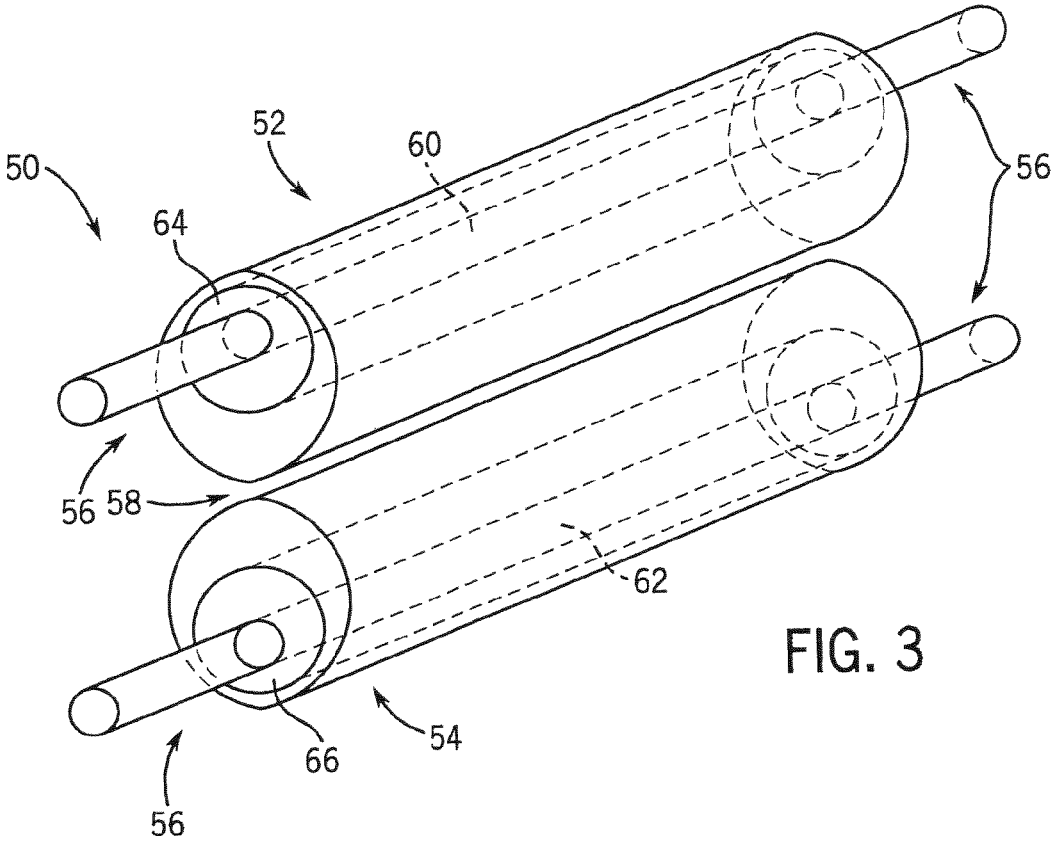
FIG. 3 is a perspective view of a pair of collimator mandrels in a first position and forming a collimator assembly for use with the CT imaging system shown in FIG. 1.

The present invention will be described with respect to the blockage, detection, and conversion of x-rays. However, one skilled in the art will appreciate that the present invention is equally applicable for the detection and conversion of other high frequency electromagnetic energy. The present invention will be described with respect to a "third generation" CT scanner, but is equally applicable with other CT systems.

Referring to FIGS. 1 and 2, a computed tomography (CT) imaging system 10 is shown as including a gantry 12 representative of a "third generation" CT scanner. Gantry 12 has an x-ray source 14 that projects a beam of x-rays 16 toward a detector array 18 on the opposite side of the gantry 12. Detector array 18 is formed by a plurality of detectors 20 which together sense the projected x-rays that pass through a medical patient 22. Each detector 20 produces an electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. A data acquisition system (DAS) 32 in control mechanism 26 samples analog data from detectors 20 and converts the data to digital signals for subsequent processing. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves portions of patient 22 through a gantry opening 48.

Referring to FIG. 3, a collimator assembly 50 having a pair of collimator mandrels 52 and 54 that are constructed to collimate x-rays projected toward a patient and detector assembly or array. Each collimator mandrel 52, 54 is designed to be rotated along a lengthwise axis by pivot assemblies 56. As will be described in greater detail below, collimator mandrel 52 is rotated clockwise and collimator mandrel 54 is rotated counterclockwise to define the width of the aperture 58 that is formed between the pair of mandrels. However, one skilled in the art would readily recognize that other rotational orientations are possible and contemplated to achieve a desired aperture shape and/or width.

X-rays are projected from an x-ray tube toward the collimator assembly 50. The mandrels 52, 54 are positioned relative to one another to define an aperture size tailored to the specific CT study to be carried out. In this regard, each mandrel is designed and constructed of material to block or prevent passage of those x-rays that are not passed through aperture 58. As such, each mandrel 52, 54 has a complexly-shaped outer layer 60, 62 of attenuating material. That is, each outer layer extends circumferentially around a rod 64, 66 of base material and a non-constant diameter. The rods 64, 66 form a solid and rigid base for the layers of attenuating material. Preferably, the rods are constructed of steel, but other materials are possible. The attenuating layers may be fabricated from tungsten or other attenuating epoxy or alloy.

As shown, each rod 64, 66 has a circular or constant diameter. In contrast, each mandrel, as a result of the non-circular attenuating layer, has a complex shape. This complexity in shape allows the collimator assembly to provide a more variable aperture size without a change in the collimator assembly itself. Simply, in one preferred embodiment, the mandrels 52 and 54 have oblong or egg-like cross-sectional shapes that extends the entire length of rods 64 and 66, respectively. However, the manufacturing process described herein allows for other mandrel shapes as well as varying attenuating layer thickness along the length of the rods.

Figure 4:
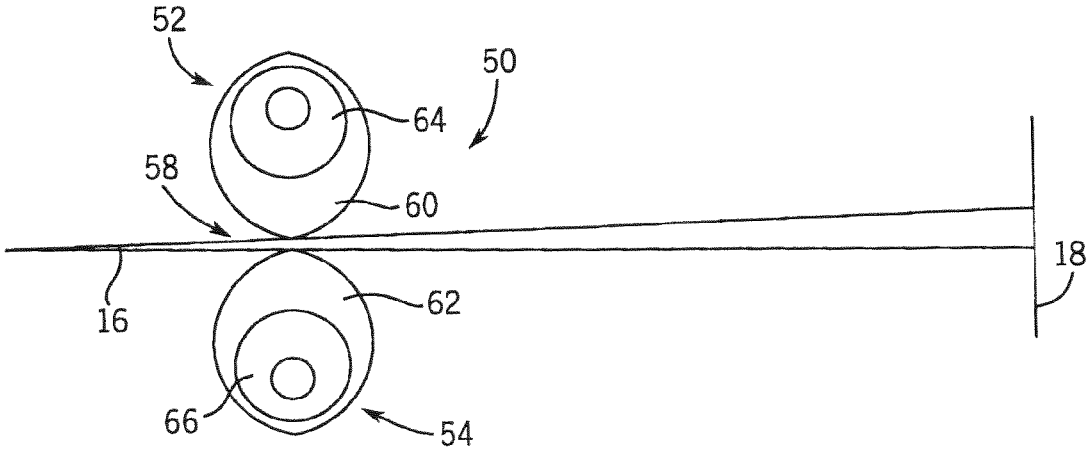
FIG. 4 is a side elevational view of the collimator assembly shown in FIG. 3 in the first position such that a minimum aperture is formed between the pair of mandrels.

Referring now to FIG. 4, a side view of the collimator assembly 50 illustrates a first or minimum aperture size that can be achieved by dynamically controlling the rotation of the mandrels 52 and 54. In the relative position illustrated, each mandrel has been rotated to maximize the amount of attenuating material 60, 62 axially positioned between each rod 64, 66. As a result, the size of aperture 58 is affected to control the expanse and coverage of x-ray beams 16 projected toward the patient (not shown) and detector assembly 18.

Figure 5:
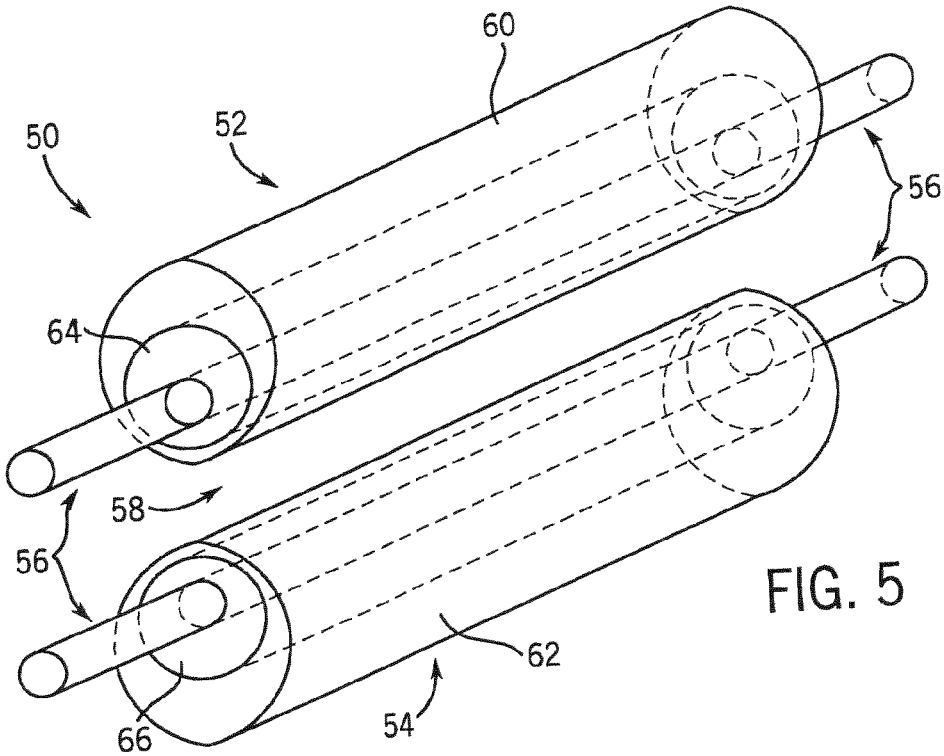
FIG. 5 is a perspective view of the pair of collimator mandrels in a second position.

In FIG. 5, the collimator assembly 50 is shown with a maximum aperture size. To achieve a maximum in the size of aperture 58, eccentrics 56 rotate each mandrel 52 and 54 such that the thinnest amount of attenuating material is positioned adjacent the x-ray path through the aperture 58. As a result, more of the x-ray beam is allowed pass through the collimator assembly unaltered by mandrels 52 and 54. Eccentric assemblies 56 may be rotated mechanically by a user or, preferably, by a controller mechanism that is electronically controlled to rotate the mandrels based on a desired aperture size. Further, while FIG. 5 illustrates rotation of both mandrels compared to that shown in FIG. 3, one mandrel may be rotated while the other mandrel remains stationary. Additionally, since each mandrel may be rotated independently by eccentrics 56, one mandrel may be rotated more than the other mandrel. As a result, the number of aperture sizes that is possible is a function of the degree change in attenuating material thickness around each rod. Moreover, one mandrel may have a layer of attenuating material that is dimensionally different from the layer of attenuating material around the other mandrel. In this regard, the number of aperture sizes available is increased.

Figure 6:
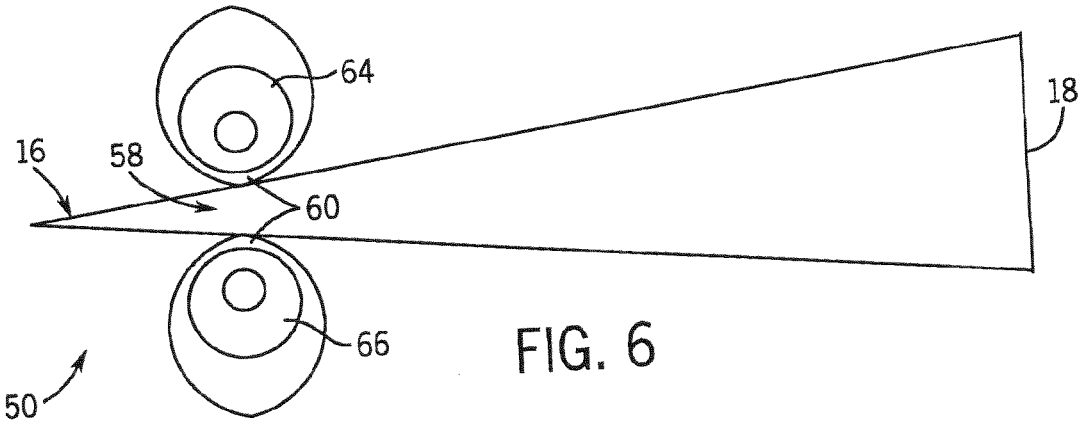
FIG. 6 is a side elevational view of the collimator assembly shown in FIG. 5 in the second position such that a maximum aperture is formed between the pair of mandrels.

FIG. 6 is a side view similar to that of FIG. 4 but illustrates a second or maximum aperture size that is achieved as a result of the relative rotation of both mandrels 52 and 54. The position of each rod 64 and 66 remains fixed, but each mandrel is caused to rotate along a lengthwise axis through the center of the rod. As a result, the thickness of the attenuating layer placed in the x-ray path is variably controlled to fit the particulars of the CT study. As is shown, aperture 58 has a much larger size in FIG. 6 than in FIG. 4; therefore, the x-ray path therebetween is much larger which allows for greater coverage in the z-direction on detector 18.

The collimator mandrel profile illustrated in FIGS. 3–6 represents one embodiment of the shape each collimator mandrel may have. However, as will be described, the manufacturing process disclosed herein is capable of constructing other-shaped mandrels than that illustrated in FIGS. 3–6. For example, the mandrels could be constructed to have lobes or other geometrical shapes to achieve the desired aperture shape.

Figure 7:
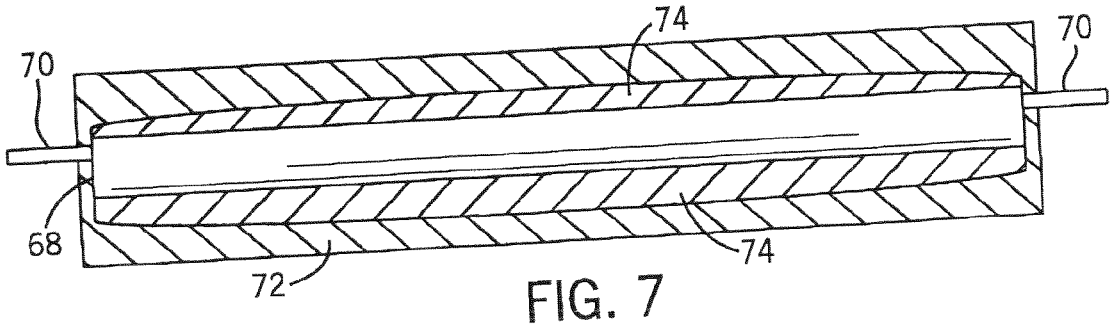
FIG. 7 is cross-sectional view of one assembly used to construct a collimator mandrel in accordance with the present invention.

Shown in FIG. 7 is a cross-sectional view illustrating the construction of a collimator mandrel in accordance with the present invention. The construction process begins with the formation of a cylindrically or other shaped rod 68 of base material having a constant cross-section. The rod 68 is constructed to have an eccentric pivot 70 on each end to support rotation of the mandrel once assembled and fit in the CT system. As noted above, the rod is preferably constructed of a solid, rigid material, i.e. steel, that is designed to receive and support a layer of attenuating material, such as tungsten, lead, a high atomic weight alloy, or epoxy laden with high atomic weight material. Rod 68 is placed is a cast 72 that envelops the rod. The cast 72 envelopes the rod such that a void 74 is created circumferentially around the outer surface of the rod 68 between the inner surface of cast. The void defines the dimensions, thickness, and shape of a layer of attenuating material to be deposited or otherwise formed to the outer surface of the rod.

In the example illustrated in FIG. 7, a highly attenuative epoxy or resin is deposited in void 74 and is allowed to cure. Once cured, the cast is removed and a tapered layer of attenuating material affixed to the outer surface of the rod results. However, use of a cast and the filling of a void between the cast and rod illustrates only one technique for forming a complexly shaped mandrel. For example, a thin layer of tungsten or other attenuative layer could be vapor or chemically deposited about the rod in a controlled manner such that a non-circular cross-sectioned or other complex shaped mandrel is constructed. In another embodiment, a thin layer of attenuating material could be sealed against the rod or core material using adhesive, glues and other intermediaries. Further, given the cast layer provides the x-ray attenuation, other attenuating materials other than tungsten may be used. As a result, the non-tungsten layer with improved machinability could be sealed against the rod and machined to provide the desired complex shape.

Figure 8:
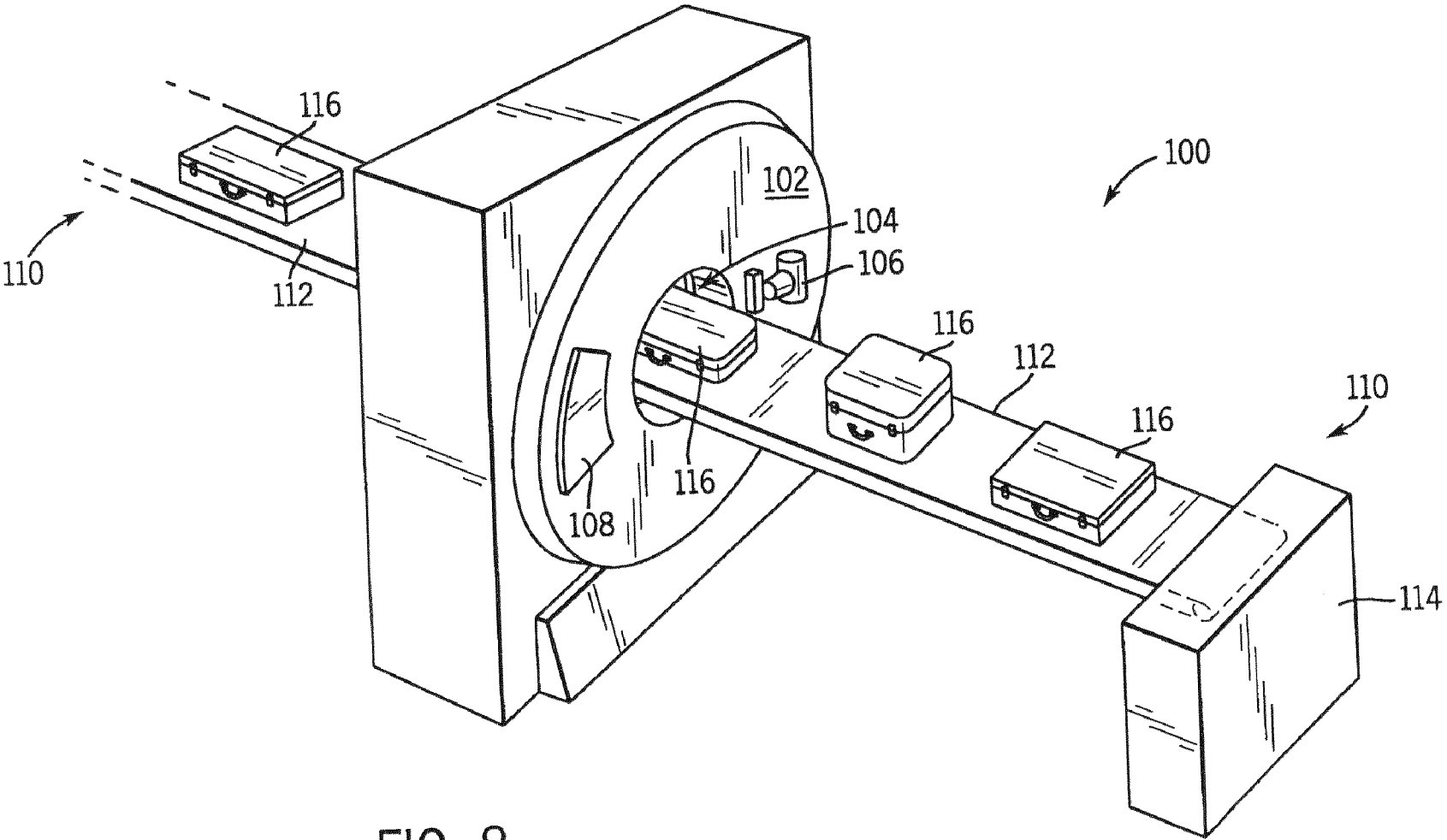
FIG. 8 is a pictorial view of a CT system for use with a non-invasive package inspection system.

Referring now to FIG. 8, package/baggage inspection system 100 includes a rotatable gantry 102 having an opening 104 therein through which packages or pieces of baggage may pass. The rotatable gantry 102 houses a high frequency electromagnetic energy source 106 as well as a detector assembly 108 having scintillator arrays comprised of scintillator cells. A conveyor system 110 is also provided and includes a conveyor belt 112 supported by structure 114 to automatically and continuously pass packages or baggage pieces 116 through opening 104 to be scanned. Objects 116 are fed through opening 104 by conveyor belt 112, imaging data is then acquired, and the conveyor belt 112 removes the packages 116 from opening 104 in a controlled and continuous manner. As a result, postal inspectors, baggage handlers, and other security personnel may non-invasively inspect the contents of packages 116 for explosives, knives, guns, contraband, and the like.

Therefore, in accordance with one embodiment of the present invention, a method of manufacturing a collimator mandrel for a CT imaging system includes the steps of forming a core of base material and applying a tapered layer of attenuating material to the core.

In accordance with another embodiment of the invention, a CT collimator mandrel comprises a solid core positioned within a layer of attenuating material. The mandrel is formed by shaping a bulk of supporting material into a core and positioning the core in a cast such that a non-uniform void is created between an outer surface of the core and an inner surface of the cast. The mandrel is further formed by injecting attenuating material into the void and removing the cast upon curing of the attenuating material.

According to yet another embodiment, a process of constructing a mandrel for a CT imaging system is provided and includes the steps of forming a solid cylindrical rod of first material and depositing a layer of second material designed to substantially block x-rays on the cylindrical rod.

The present invention has been described in terms of the preferred embodiment, and it is recognized that equivalents, alternatives, and modifications, aside from those expressly stated, are possible and within the scope of the appending claims.

The invention claimed is:

1. A method of manufacturing a collimator mandrel for a CT imaging system, the method comprising the steps of:

forming a core of base material, wherein the core includes a cylindrical rod; and applying a tapered layer of x-ray attenuating material to the core, wherein the step of applying includes:

placing a cast circumferentially around the core, wherein the cast has an inner surface creating varying degrees of thickness circumferentially around the core; and placing the cast circumferentially around the core such that a void of varying thickness is created between an outer surface of the core and an inner surface of the cast and filling the void with the attenuating material and allowing the attenuating material to cure and then removing the cast.

2. The method of claim 1 wherein the attenuating material is at least one of an attenuating alloy and an attenuating epoxy.

3. The method of claim 1 wherein the attenuating material is tungsten.

4. The method of claim 3 further comprising the step of affixing a thin layer of tungsten to the core and then machining the thin layer to have a varying thickness.

5. The method of claim 1 wherein the base material includes stainless steel.

6. A CT collimator mandrel comprising a solid cylindrical rod positioned within a layer of attenuating material, the mandrel formed by:

shaping a bulk of supporting material into a core;

positioning the core in a cast such that a non-uniform void is created between an outer surface of the core and an inner surface of the cast;

placing attenuating material into the void; and removing the cast upon curing of the attenuating material.

7. The CT collimator mandrel of claim 6 further formed by machining the cured attenuating material to create a tapered attenuating material layer.

8. The CT collimator mandrel of claim 6 wherein the attenuating material extends circumferentially around an entire length of the core.

9. The CT collimator mandrel of claim 6 wherein the supporting material includes stainless steel and the attenuating material includes tungsten.

10. A process of constructing a mandrel for a CT imaging system, the process comprising the steps of:

forming a solid cylindrical rod of a first material;

depositing a layer of a second material designed to substantially block x-rays on the cylindrical rod; and affixing a pivot stud to each end of the cylindrical rod to support connection of the rod to an eccentrics assembly.

11. The process of claim 10 wherein the first material includes stainless steel.

12. The process of claim 10 wherein the second material includes tungsten.

13. The process of claim 12 further comprising the step of machining the layer of second material to be tapered circumferentially around the rod.

14. A method of manufacturing a collimator mandrel for a CT imaging system, the method comprising the steps of:

forming a core of base material; and applying a tapered layer of attenuating material to the core, wherein the step of applying includes:

placing a cast circumferentially around the core, wherein the cast has an inner surface creating varying degrees of thickness circumferentially around the core;

placing the cast circumferentially around the core such that a void of varying thickness is created between an outer surface of the core and an inner surface of the cast;

filling the void with the attenuating material; and allowing the attenuating material to cure and then removing the cast.

15. The method of claim 14 wherein the attenuating material is at least one of an attenuating alloy and an attenuating epoxy.

16. The method of claim 14 wherein the attenuating material is tungsten.

17. The method of claim 14 wherein the core includes a cylindrical rod.

18. The method of claim 14 wherein the base material includes stainless steel.

* * * * *